US009562752B1

(12) United States Patent
Rappaport

(10) Patent No.: US 9,562,752 B1
(45) Date of Patent: Feb. 7, 2017

(54) TOY ARROW

(71) Applicant: Mark Rappaport, Escondido, CA (US)

(72) Inventor: Mark Rappaport, Escondido, CA (US)

(73) Assignee: Marky Sparky, Inc., Escondido, CA (US)

( * ) Notice: Subject to any disclaimer, the term of this patent is extended or adjusted under 35 U.S.C. 154(b) by 0 days.

(21) Appl. No.: 14/942,610

(22) Filed: Nov. 16, 2015

Related U.S. Application Data

(60) Provisional application No. 62/079,806, filed on Nov. 14, 2014.

(51) Int. Cl.
*F42B 6/04* (2006.01)

(52) U.S. Cl.
CPC ..... *F42B 6/04* (2013.01)

(58) Field of Classification Search
CPC ..... F42B 6/04; F42B 6/06; F42B 6/08
See application file for complete search history.

(56) References Cited

U.S. PATENT DOCUMENTS

| | | | | |
|---|---|---|---|---|
| 3,841,635 | A | 10/1974 | Wilson | |
| 4,234,190 | A * | 11/1980 | Airhart | F42B 6/04 273/DIG. 23 |
| 5,242,323 | A | 9/1993 | Rappaport | |
| 8,012,049 | B1 * | 9/2011 | Walterscheid | F42B 6/003 473/572 |
| 8,449,413 | B1 * | 5/2013 | Jackson | F42B 6/08 473/578 |
| 8,932,159 | B2 * | 1/2015 | Lennon | F42B 6/08 473/578 |
| 8,968,126 | B2 * | 3/2015 | Chia | F42B 6/08 473/578 |
| 2006/0046877 | A1 * | 3/2006 | Gajda, Jr. | F42B 6/10 473/572 |
| 2014/0256479 | A1 * | 9/2014 | Bynum, Jr. | F42B 6/08 473/470 |

* cited by examiner

*Primary Examiner* — John Ricci
(74) *Attorney, Agent, or Firm* — The Farrell Law Firm, P.C.; John F. Gallagher, III

(57) ABSTRACT

Provided is an arrow that includes a shaft, a forward tip affixed to a first end of the shaft, a rear tip affixed on a second end of the shaft, and a plurality of fins. The shaft is formed by extruding a flexible plastic, forming a thin wall that extends an entire length of the shaft and enclosing a hollow.

7 Claims, 1 Drawing Sheet

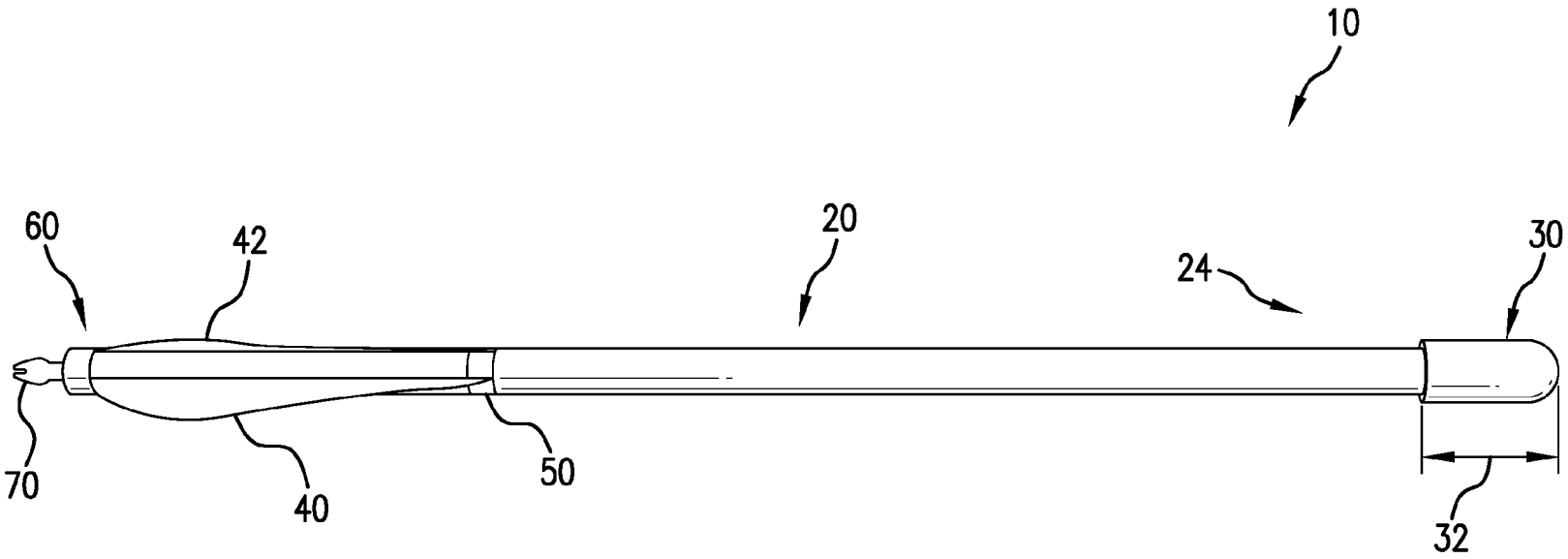
10
30
32
24
20
50
40
42
60
70

TOY ARROW

PRIORITY

This application claims priority to U.S. Provisional Application No. 62/079,806 filed on Nov. 14, 2014 in the U.S. Patent and Trademark Office, the entire disclosure of which is hereby incorporated herein by reference.

1. Field of the Invention

The present invention relates generally to a toy arrow and, more particularly, to a toy arrow formed from a hollow flexible plastic cylinder with a safety tip.

2. Description of the Related Art

Numerous types of toy arrows are known in the art, with the usefulness and function of each being limited by the construction, manner of propulsion and arrangement of the various elements of the arrow.

U.S. Pat. No. 5,242,323 provides an air-pulse powered toy bow and arrow set that includes an a soft arrow with a shaft formed of resilient, flexible foam material, and a rear section of the shaft having an open, axial bore to facilitate sliding the arrow onto a launching tube, which extends into the axial bore. An air gun couples to the tube. When the air gun is cocked and fired, compressed air is delivered to the launching tube, thereby propelling the arrow.

U.S. Pat. No. 3,841,635 provides a toy arrow suction cup tip that allows for releasable attachment to a smooth surfaced target. The tip readily collapses when pinched, making it difficult for a child to grip the tip in the event of an attempt to pull the tip from the shaft.

SUMMARY OF THE INVENTION

The present invention overcomes shortcomings of conventional toy arrows by providing an arrow having an elongated flexible hollow plastic shaft that extends a length of the shaft in a lengthwise direction, a soft foam tip fixedly attached to and closing a forward end of the shaft, a plurality of lightweight fins, and a rear tip attached to a rear, opposite end of the shaft that closes the shaft, which is hollow along an entire length thereof.

BRIEF DESCRIPTION OF THE DRAWINGS

For a better understanding of the invention as well as other objects and further features thereof, reference is made to the following detailed description to be read in conjunction with the accompanying drawings, wherein:

FIG. 1 is a side elevation of an arrow of the present invention.

DETAILED DESCRIPTION OF THE PREFERRED EMBODIMENTS

The following detailed description of the preferred embodiments of the invention makes reference to the accompanying drawing(s). In describing the invention, explanation of related functions or constructions known in the art are omitted for the sake of clearness in understanding the concept of the invention, to avoid obscuring the description of the invention with unnecessary detail.

As shown in the side elevation provided in FIG. 1, of arrow 10 includes an elongated shaft 20. The elongated shaft 20 formed of a thin-wall, flexible plastic. The thin-wall plastic surrounds a hollow that extends an entire length of shaft 20, in a lengthwise direction thereof.

Shaft 20 is preferably formed of extruded flexible plastic that is bendable and has a shape memory, to return arrow 20 to its original shape after bending.

Forward tip 30 of shaft 20 is formed of soft foam, fixedly attached to forward end 24 of shaft 20 by bonding agent or pressure fit, thereby closing forward end 24 of shaft 20. Tip length 32 is preferably approximately two inches for an arrow of approximately thirty-three inches in length, with a ratio of 1:13 of tip length to overall arrow length.

A plurality of fins 40, 42 are provided to create drag during flight of arrow 10. Fins 40, 42 are sufficiently light in weight, relative to arrow 10.

A forward end of each of the plurality of fins 40, 42 is, in one embodiment, secured by tape 50 that encircles an outer circumference of shaft 20.

Rear tip 60 is provided at an end of shaft 20 opposite forward end 24, to close the end of shaft 20 that is opposite forward end 24.

Rear tip 60 is formed of a rigid plastic.

Rear tip 60 includes a nock 70.

Nock 70 is configured to receive a bowstring of a conventional bow for application of a force to propel arrow 10 from the bow, by inserting the bowstring into nock 70 when arrow 10 is held at a proper point along the length of a bowstring of the bow, typically with arrow 10 held on a top of a handhold on the bow to avoid arrow 10 from falling from the bow prior to release of the bowstring.

Elongated shaft 20 is preferably configured as an oversized tube of sufficient lengthwise rigidity to maintain shape while the bowstring pushes on nock 70, to propel arrow 10 from the bow.

Shaft 20 is preferably formed from plastic having a thickness of approximately 0.3-0.5 mm, rolled or extruded into a tube shape. The shape-retaining oversized tube of elongated shaft 20 requires less power to launch arrow 10 at a higher rate of speed than needed to launch a conventional arrow.

The rigidity of elongated shaft 20 avoids buckling of arrow 10 from the force exerted when the bowstring is released, to launch the arrow.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A toy arrow comprising:

a shaft;

a forward tip fixedly attached to a first end of the shaft;

a rear tip fixedly attached on a second end of the shaft;

a soft foam fixedly attached to and covering the forward tip; and a plurality of fins, wherein the shaft includes a hollow, wherein the hollow extends from the forward tip to the rear tip, wherein the shaft is formed of a thin, flexible plastic, wherein the thin, flexible plastic has a shape memory configured to return the shaft to its original shape after bending thereof, and wherein the soft foam protrudes forward of the forward tip and extends rearward, overlapping a portion of the shaft extending rearward of the forward tip.

2. The toy arrow of claim 1, wherein the plastic forms a wall surrounding the hollow.

3. The toy arrow of claim 2, wherein the hollow occupies a majority of a diameter of the shaft.

4. The toy arrow of claim 1, further comprising a nock affixed to the rear tip.

5. The toy arrow of claim 4, wherein a distal end of the nock is configured to receive a bowstring.

6. The toy arrow of claim 1, wherein the plurality of fins are affixed at a predetermined spacing around an exterior of the shaft, adjacent to the rear tip.

7. A toy arrow comprising:

a shaft including a hollow;

a forward tip attached to a first end of the shaft;

a rear tip attached to a second end of the shaft opposite the first end; and a soft foam attached to and covering the forward tip, wherein the soft foam protrudes forward of the forward tip, and wherein the soft foam extends rearward of the forward tip to overlap a portion of the shaft.

* * * * *